US007225123B2

(12) United States Patent
Ha

(10) Patent No.: US 7,225,123 B2
(45) Date of Patent: May 29, 2007

(54) METHOD FOR COMPRESSING AUDIO SIGNAL USING WAVELET PACKET TRANSFORM AND APPARATUS THEREOF

(75) Inventor: Ho-jin Ha, Seoul (KR)

(73) Assignee: Samsung Electronics Co. Ltd., Suwon, Kyungki-do (KR)

( * ) Notice: Subject to any disclaimer, the term of this patent is extended or adjusted under 35 U.S.C. 154(b) by 842 days.

(21) Appl. No.: 10/367,997

(22) Filed: Feb. 19, 2003

(65) Prior Publication Data

US 2004/0044526 A1 Mar. 4, 2004

(30) Foreign Application Priority Data

Feb. 16, 2002 (KR) ..... 2002-8305

(51) Int. Cl.
*G10L 11/00* (2006.01)

(52) U.S. Cl. ..... 704/200.1

(58) Field of Classification Search ..... 704/200.1
See application file for complete search history.

(56) References Cited

OTHER PUBLICATIONS

Rulon et al.; A Comparison of Audio cpmpression transforms; Proceedings IEEE Mar. 25-28, 1999, pp. 253-257.*

* cited by examiner

*Primary Examiner*—Abul K. Azad
(74) *Attorney, Agent, or Firm*—Sughrue Mion, PLLC

(57) ABSTRACT

An audio compression method using wavelet packet transform (WPT) in MPEG1 layer 3 (hereinafter referred to as "MP3") and a system thereof are provided. The method comprises calculating perceptual energy by analyzing audio samples which are input based on a psychoacoustic model; according to comparison of the level of the calculated perceptual energy with a threshold, selectively determining a modified DCT (MDCT) processing window and a wavelet packet transform (WPT) processing window; by processing audio samples corresponding to the scopes of the determined windows in the MDCT and WPT, converting the audio samples into data on frequency domains; and quantizing the processed data on the frequency domains according to the number of assigned bits.

9 Claims, 6 Drawing Sheets

METHOD FOR COMPRESSING AUDIO SIGNAL USING WAVELET PACKET TRANSFORM AND APPARATUS THEREOF

BACKGROUND OF THE INVENTION

1. Field of the Invention

The present invention relates to an audio compression system, and more particularly, to an audio compression method using wavelet packet transform (WPT) in MPEG1 layer 3 (hereinafter referred to as "MP3") and a system thereof. The present application is based on Korean Patent Application No. 2002-8305, which is incorporated herein by reference.

2. Description of the Related Art

Generally, in an MPEG standard method, monaural audio is encoded at the rate of 128 kbps, while a layered algorithm is used to encode stereo audio at the rates of 192 kbps, 92 kbps, and 64 kbps. In the layers, layer 3 is known as an MP3 technology. The MP3 technology increases the resolution of a frequency domain by adding a modified DCT (MDCT) operation, and, by considering input characteristics in the MCDT operation, adjusts the size of a window so that pre-echo and aliasing are compensated for.

FIG. 1 is a flowchart showing a conventional audio compression method using MP3 technology.

First, pulse code modulation (PCM)-type audio data is input in step 110.

Then, PCM audio data is divided into 576 samples in each granule.

By applying a psychoacoustic model defined in the MPEG1 layer 3 to the samples, perceptual energy is obtained in step 120.

Next, the perceptual energy obtained from the psychoacoustic model is compared with a threshold, and according to the comparison result, MDCT is performed with switching windows in step 130. Here, a part of the MDCT window or the entire MDCT window may be switched according to the threshold. That is, as shown in FIG. 2, if the level of the perceptual energy is higher than the threshold, this corresponds to an attack state signal, whose energy level rapidly increases, and therefore a short window is selected. If the level of the perceptual energy is lower than the threshold, this corresponds to a constant state signal, and therefore a long window is selected. Accordingly, audio samples in the respective selected window scopes are MCDT-processed and converted into data in frequency domains. At this time, a start window or a stop window is used to switch from the long window to the short window.

Also, in the MPEG1 layer 3, the types of windowing are disclosed as a long window, a start window, a short window, and a stop window, as shown in FIG. 3. Also, as shown in FIG. 2, the windows overlap each other in order to prevent aliasing.

Then, data on the frequency domain for which MDCT is performed are quantized according to the number of assigned bits in step 140.

The quantized data is formed as a bit stream based on a Huffman coding method in step 150.

Therefore, as shown in FIG. 1, the prior art audio signal compression method uses the MDCT window switching method to compress a non-stationary signal which causes a pre-echo effect. However, the prior art audio compression method using the MDCT as shown in FIG. 1 degrades sound quality of low bit rates, less than, for example, 128 kbps (64 kbps, stereo), due to the limit of the MDCT base.

SUMMARY OF THE INVENTION

To solve the above problems, it is an objective of the present invention to provide an audio compression method and apparatus in which audio data is compressed adaptively using the MDCT and WPT so that a non-stationary signal can be effectively compressed and at the same time an audio signal can be effectively compressed even in a low bit rate.

According to an aspect of the present invention, there is provided an audio compression method comprising calculating perceptual energy by analyzing audio samples which are input based on a psychoacoustic model; according to comparison of the level of the calculated perceptual energy with a threshold, selectively determining a modified DCT (MDCT) processing window and a wavelet packet transform (WPT) processing window; by processing audio samples corresponding to the scopes of the determined windows in the MDCT and WPT, converting the audio samples into data on frequency domains; and quantizing the processed data on the frequency domains according to the number of assigned bits.

According to another aspect of the present invention, there is provided an audio compression apparatus comprising a filter bank unit which divides the bands of audio samples being input, by a polyphase bank; a psychoacoustic model analyzing unit which analyzes perceptual energy from the input audio samples based on a psychoacoustic model; a TS selecting unit which selects one of MDCT and WPT windows by comparing the perceptual energy analyzed in the psychoacoustic model with a predetermined threshold; and a TS processing unit which performs MDCT and WPT for the samples whose bands are divided in the filter bank unit, according to the MDCT and WPT windows selected in the TS selecting unit.

BRIEF DESCRIPTION OF THE DRAWINGS

The above objects and advantages of the present invention will become more apparent by describing in detail preferred embodiments thereof with reference to the attached drawings in which.

DESCRIPTION OF THE PREFERRED EMBODIMENTS

Figure 1:
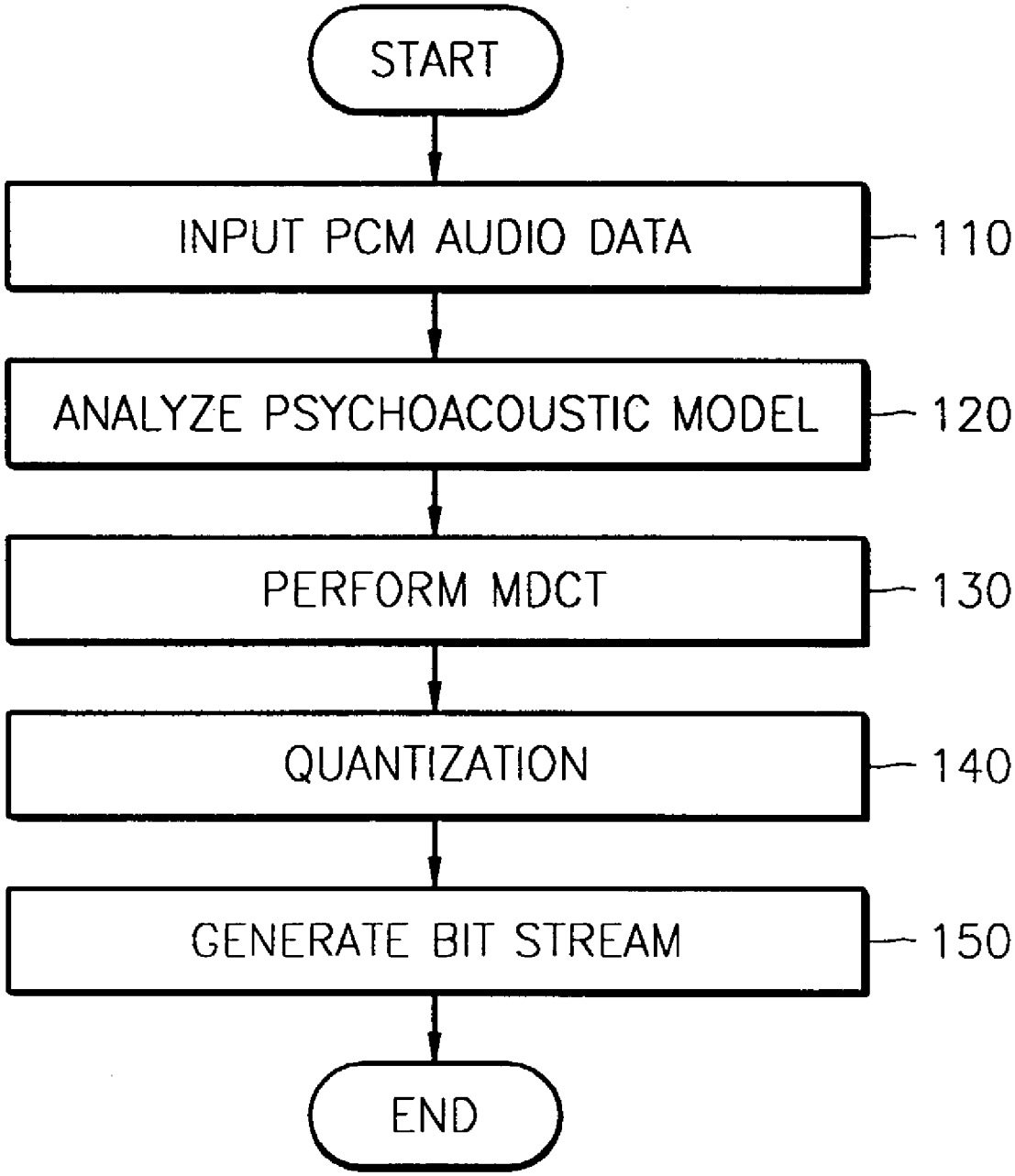
FIG. 1 is a flowchart showing a conventional audio compression method using the MP3 standard.
Figure 2:
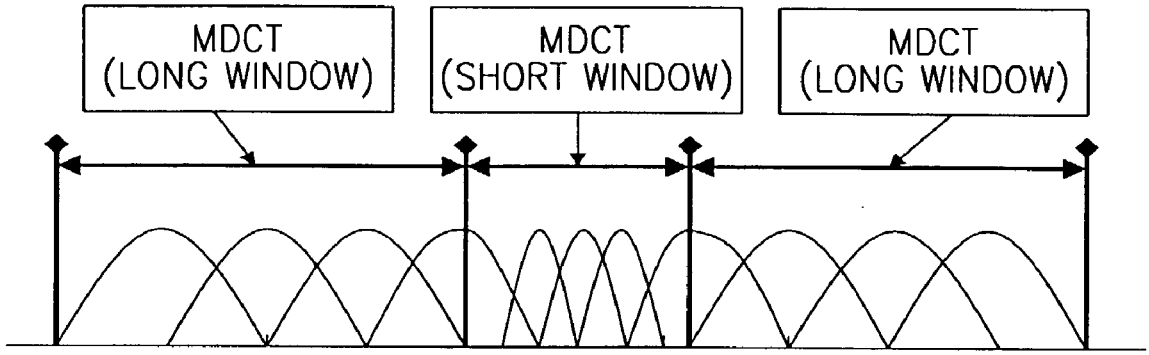
FIG. 2 is a schematic diagram showing prior art MDCT processing steps in a frequency domain.
Figure 3:
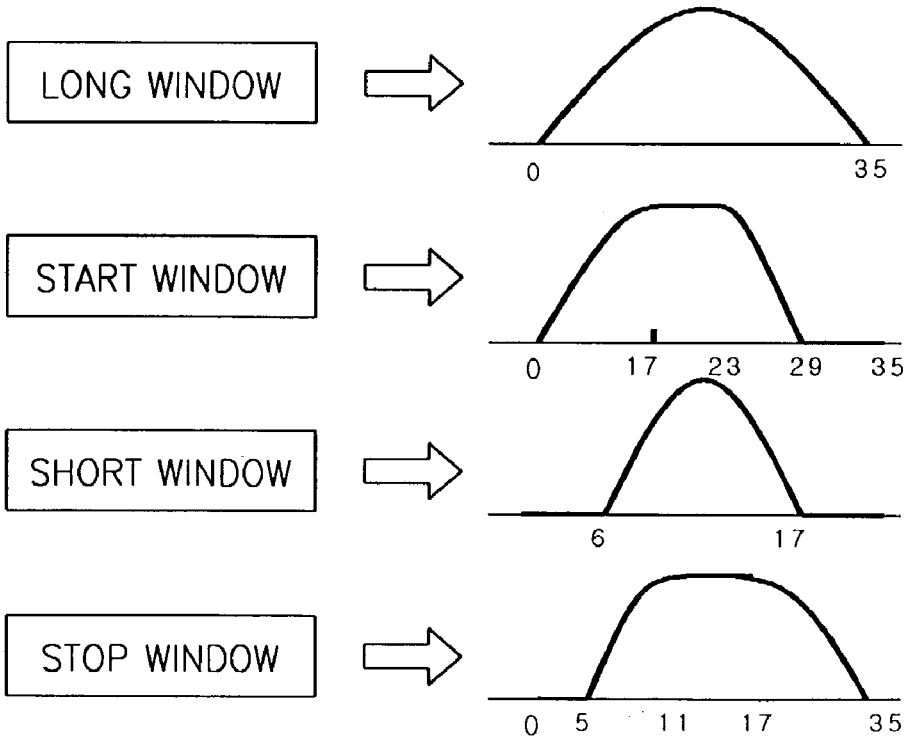
FIG. 3 shows the types of prior art windows.
Figure 4:
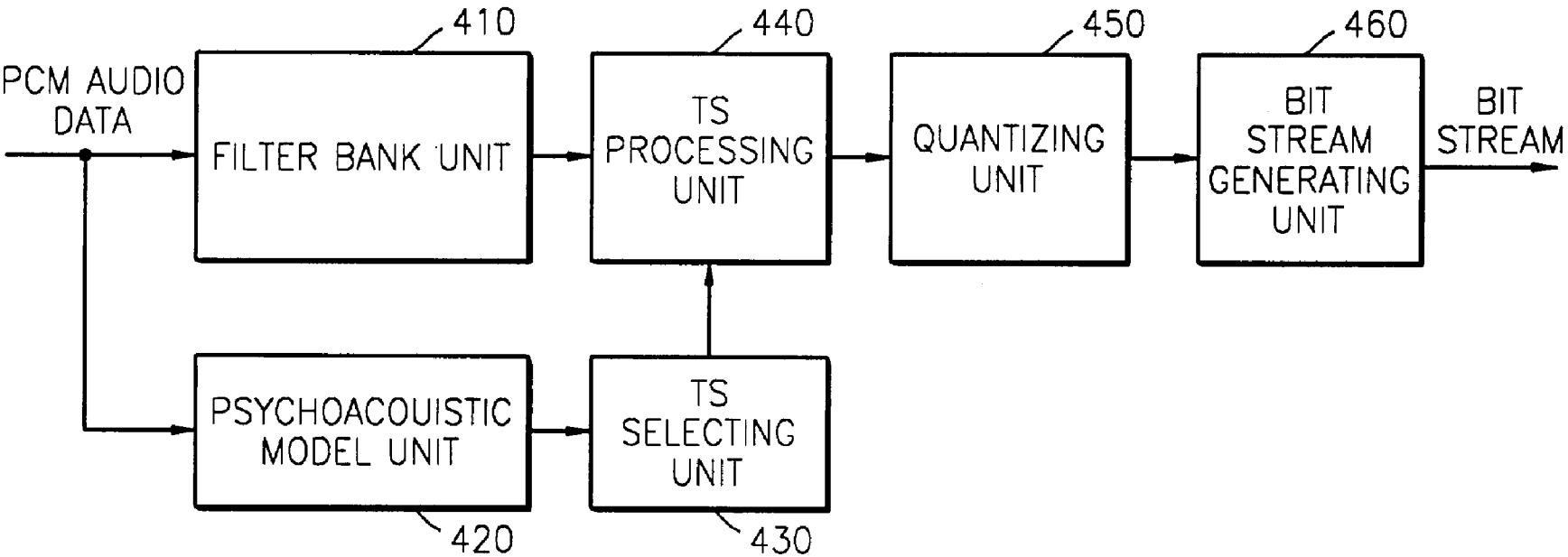
FIG. 4 is a block diagram of an audio signal compression system according to the present invention.

The audio signal compression system according to the present invention of FIG. 4 comprises a filter bank unit 410, an acoustic psychological model unit 420, a TS selecting unit 430, a TS processing unit 440, a quantizing unit 450, and a bit stream generating unit 460.

First, the wavelet packet transform (WPT) used in the present invention is a kind of sub-band filtering, in which a signal is broken down into multiple levels on a wavelet basis and if the number of levels increases, resolution for a frequency increases. Also, the signal characteristics of an attack part make the analysis of the wavelet basis easier.

Referring to FIG. 4, the filter bank unit 410 divides PCM audio samples that are input in units of granules, into 32 bands by using a polyphase bank.

Using a psychoacoustic model, the acoustic psychological model unit 420 obtains perceptual energy. In the human acoustic characteristics, there is a mask effect in which a frequency component having a higher level masks neighboring frequencies having a lower level. Accordingly, using this human acoustic characteristic, the level of energy that can be perceived is obtained.

The TS selecting unit 430 compares the perceptual energy obtained by the psychoacoustic model with a threshold to generate a control signal for selecting an MDCT window or a WPT window. That is, if the level of the perceptual energy is higher than the threshold, this corresponds to an attack state signal whose energy level rapidly increases and the TS selecting unit 430 selects a WPT window, while if the level of the perceptual energy is lower than the threshold, this corresponds to a steady state signal whose energy level is constant and the TS selecting unit 430 selects an MDCT window.

For the samples whose bands are divided in the filter bank unit 410, the TS processing unit 440 selectively processes the MDCT processing window and the WPT processing window according to the control signal output from the TS selecting unit 430, and performs MDCT processing and WPT processing for the samples corresponding the selected respective window scopes.

The quantizing unit 450 quantizes audio data on the frequency domain, which are TS processed in the TS processing unit 440, according to the number of assigned bits.

The bit stream generating unit 460 forms audio data quantized in the quantizing unit 450 as a bit stream.

Figure 5:
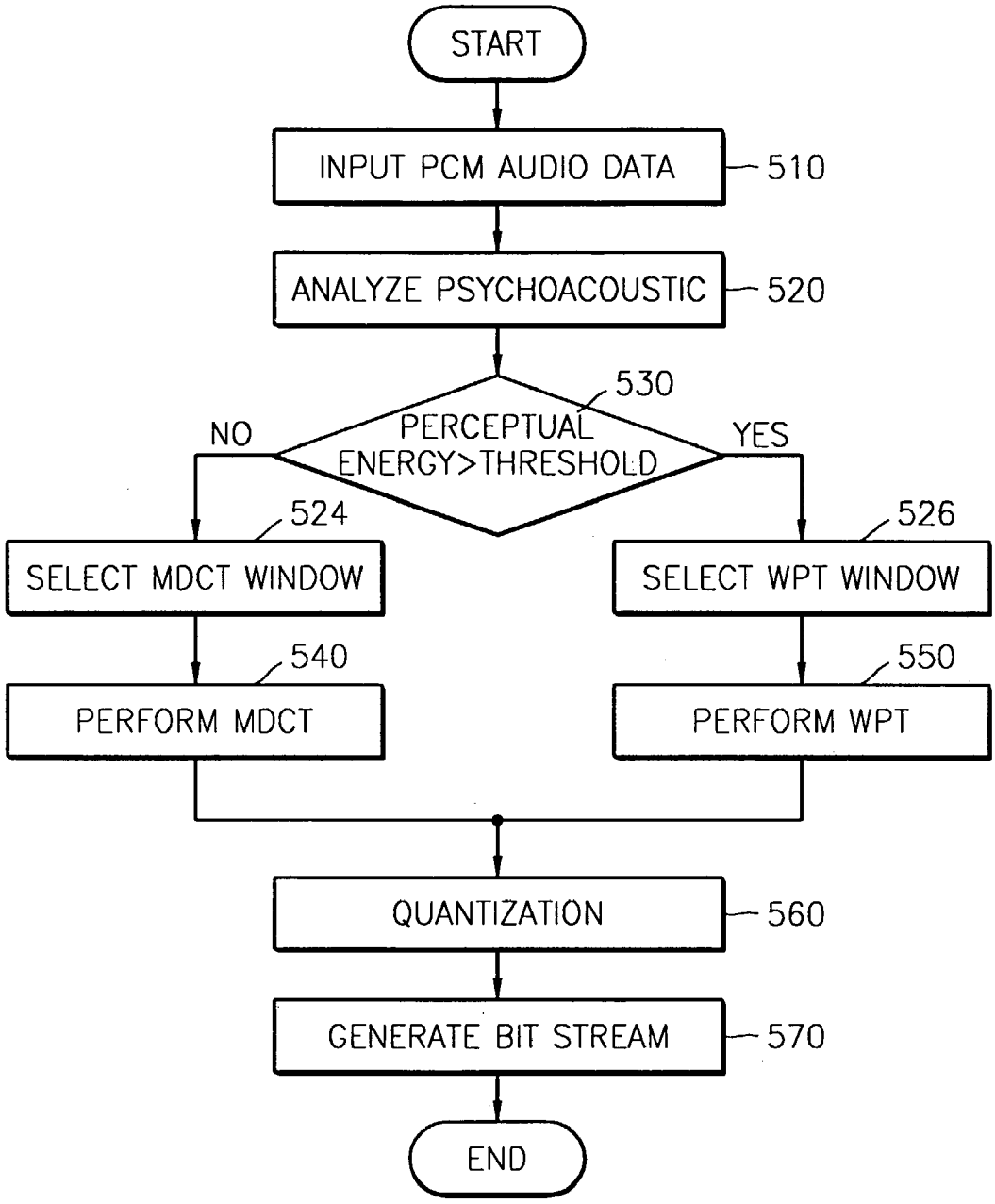
FIG. 5 is a flowchart showing an audio signal compression method according to the present invention.

FIG. 5 is a flowchart showing an audio signal compression method according to the present invention.

First, the PCM audio data, which are input after being divided into 576 samples for each granule, are divided into 32 bands through a filter bank in step 510.

Then, the psychoacoustic model is applied to the divided samples so that perceptual energy is obtained in step 520.

Next, in order to determine one of the MDCT processing window and the WPT processing window, the perceptual energy obtained in the psychoacoustic model is compared with the threshold in step 530. Here, using the fact that the wavelet characteristic is similar to the attack state signal, the WPT window is applied to the attack state signal.

Then, if the level of the perceptual energy is higher than the threshold, this corresponds to the attack state signal whose energy level rapidly increases and the WPT window is selected in step 526, and if the level of the perceptual energy is lower than the threshold, this corresponds to the steady state signal whose energy level is constant and the MDCT window is selected in step 524.

Next, data corresponding to each of the selected windows are MDCT or WPT are processed and converted into audio data on frequency domains in steps 540 and 550, respectively. At this time, the WPT analyzes the samples of the frequency domain of the attack part hierarchically through a wavelet filter.

Then, data on the frequency domain for which MDCT is performed are quantized according to the number of assigned bits in step 560.

Using the Huffman coding, the quantized data are formed as a bit stream in step 570.

Figure 6:
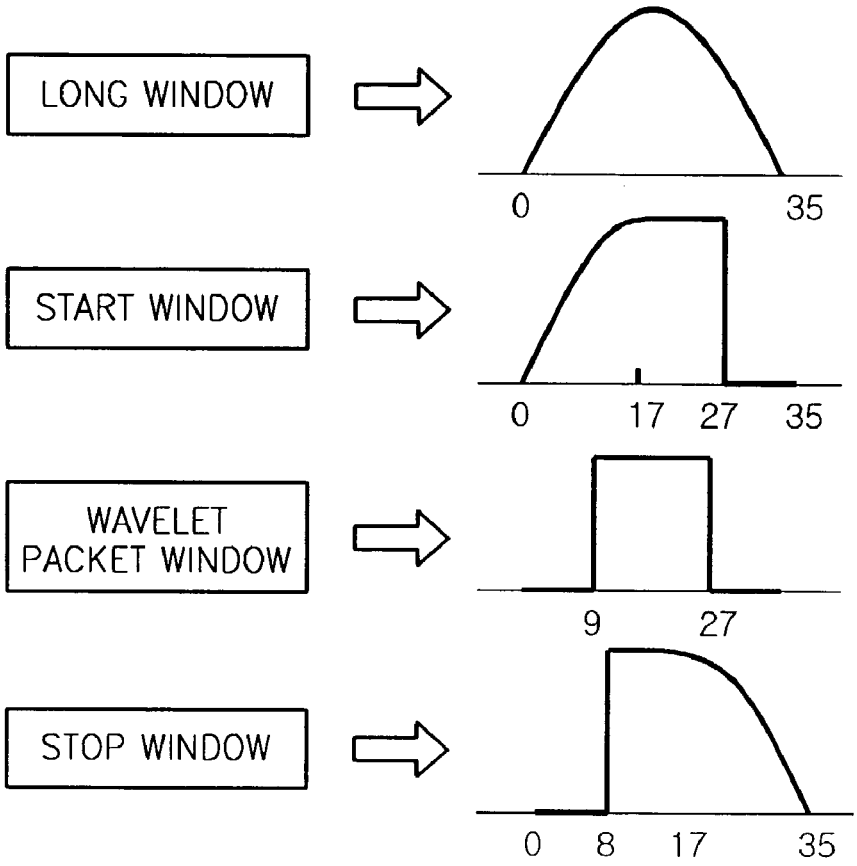
FIG. 6 shows the types of MDCT and WPT windows according to the present invention.

FIG. 6 shows the types of MDCT and WPT windows according to the present invention.

Referring to FIG. 6, the long window, the start window, and the stop window perform MDCT, and the WPT window (wavelet packet window) performs WPT. The MDCT windows and the WPT window are formed in shapes satisfying perfect reconstruction (PR) conditions. The PR conditions enable reconstruction such that frequency domain data in encoding are the same as the frequency domain data in decoding. At this time, the long window has a length of 36 samples and is used for the steady state signal. The start window has a length of 28 samples, and is used for a part where the steady signal or the attack signal begins. The WPT window having a length of 18 samples is a combined type of the MDCT start window and stop window and is used for the attack state signal. The stop window has the length of 28 samples and is used for a part where the attack state signal or the steady state signal ends.

Figure 7:
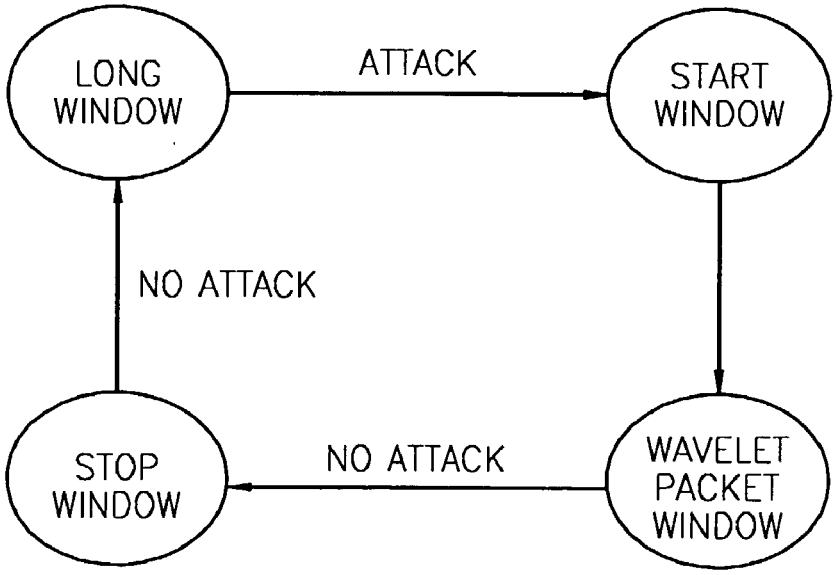
FIG. 7 is a state diagram of window switching in the MDCT and WPT.

FIG. 7 is a state diagram of window switching in the MDCT and WPT.

First, in a part where the level of energy is lower than the threshold, the long window state is maintained. If the attack signal begins, this means a state where a part of a signal in which the energy level is higher than the threshold begins and accordingly the state of the long window is transited to the start window state. Then, the start window state is transited to the wavelet packet window state for processing the attack signal. Then, the wavelet packet window is maintained as the original state in a part where the energy level is higher than the threshold. At this time, if the steady signal begins, this means a state where a part of a signal in which the energy level is lower than the threshold begins and accordingly the state of the wavelet packet window is transited to the stop window state (referred to as NO ATTACK in FIG. 7). Then, the stop window state is transited to the long window state for processing the steady signal (referred to as NO ATTACK in FIG. 7).

Figure 8:
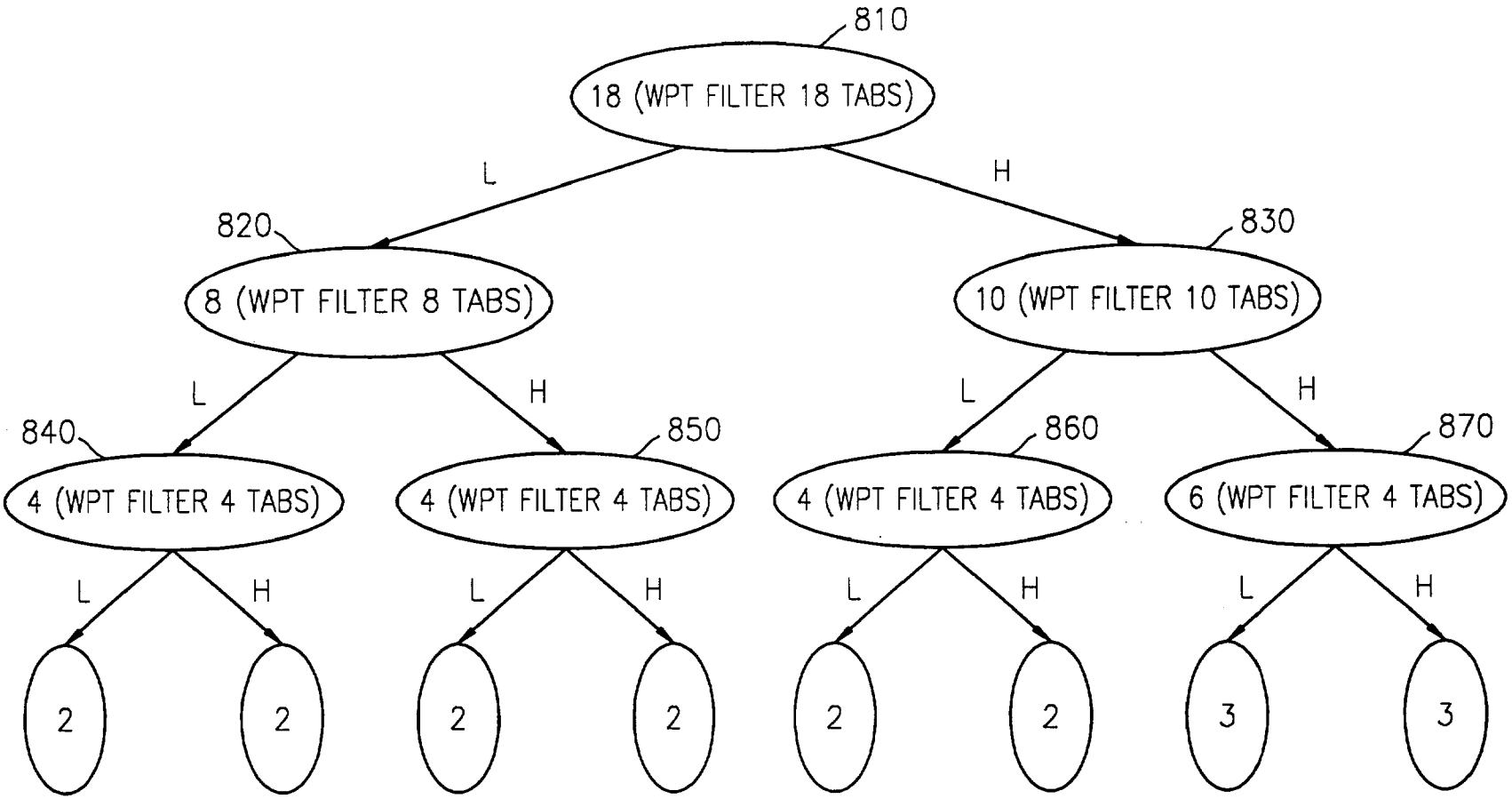
FIG. 8 is a diagram of the structure of a WPT tree processed in a frequency domain according to the present invention.

FIG. 8 is a diagram of the structure of a WPT tree processed in a frequency domain according to the present invention.

First, the samples on the frequency domains are divided into samples of a low frequency area (L) and samples of a high frequency area (H) through an 18 coefficient WPT filter 810.

Then, the samples of the low frequency area (L) filtered in the 18 coefficient WPT filter 810 are divided into samples of a low frequency area (L) and samples of a high frequency area (H) through an 8 coefficient WPT filter 820, while the samples of the high frequency area (H) filtered in the 18 coefficient WPT filter 810 are divided into samples of a low frequency area (L) and samples of a high frequency area (H) through a 10 coefficient WPT filter 830.

Then, the samples of the low frequency area (L) filtered in the 8 coefficient WPT filter 820 are divided into samples of a low frequency area (L) and samples of a high frequency area (H) through a 4 coefficient WPT filter 840, while the samples of the high frequency area (H) filtered in the 8 coefficient WPT filter 820 are divided into samples of a low frequency area (L) and samples of a high frequency area (H) through a 4 coefficient WPT filter 850. The samples of the low frequency area (L) filtered in the 10 coefficient WPT filter 830 are divided into samples of a low frequency area (L) and samples of a high frequency area (H) through a 4 coefficient WPT filter 860. The samples of the high frequency area (H) filtered in the 10 coefficient WPT filter 830 are divided into samples of a low frequency are (L) and samples of a high frequency area (H) through a 6 coefficient WPT filter 870.

Then, the samples of the high frequency area (H) and low frequency area (L) filtered in the 4 coefficient WPT filters 840 through 860 and the 6 coefficient WPT filter 870 are divided into a plurality of bands. Samples of bands which are finally divided more finely are used in WPT processing.

As described above, the present invention compresses an audio signal by selectively switching the MDCT window and the WPT window even at a low bit rate such that a non-stationary signal is effectively processed. Also, even at a low bit rate, the MDCT which enables finer analysis of audio data is applied such that compact disc quality can also be maintained in the low bit rate. In addition, the present invention uses the WPT window having a characteristic similar to that of the attack state signal such that pre-echo can be effectively prevented.

What is claimed is:

1. An audio compression method comprising:

calculating perceptual energy by analyzing audio samples which are input, based on a psychoacoustic model;

comparing a level of the calculated perceptual energy with a threshold, and, based on the comparison, selectively determining a modified DCT (MDCT) processing window and a wavelet packet transform (WPT) processing window;

by processing audio samples corresponding to scopes of the determined processing windows in the MDCT and WPT, converting the audio samples into data on frequency domains; and quantizing the processed data on the frequency domains according to the number of assigned bits.

2. The audio compression method of claim 1, wherein in selectively determining, if the level of the calculated perceptual energy is higher than the threshold, the WPT processing window is selected, and if the level of the calculated perceptual energy is lower than the threshold, the MDCT processing window is selected.

3. The audio compression method of claim 1, wherein in selectively determining, the WPT processing window is selected in an attack state signal, and the MDCT processing window is selected in a steady state signal.

4. The audio compression method of claim 1, wherein in the WPT, data on a frequency area are hierarchically analyzed through a wavelet filter.

5. The audio compression method of claim 4, wherein data on the frequency domains are divided into N-levels of high frequency areas and low frequency areas through a wavelet filter.

6. The audio compression method of claim 1, wherein the MDCT processing window and the WPT processing window are formed to satisfy perfect reconstruction (PR) conditions.

7. The audio compression method of claim 1, wherein determining the WPT window processing comprises:

maintaining a long window state in a part of a signal where the energy level is lower than the threshold;

the window state transiting from a start window state to a wavelet packet window state if a part of a signal where the energy level is higher than the threshold begins; and the wavelet packet window state transiting from the stop window state to the long window state if a part of the signal where the energy level is lower than the threshold begins in the part of the signal where the energy level is higher than the threshold.

8. An audio compression apparatus comprising:

a filter bank unit which divides the bands of audio samples being input, by a polyphase bank;

a psychoacoustic model analyzing unit which analyzes perceptual energy from the input audio samples based on a psychoacoustic model;

a TS selecting unit which selects one of modified discrete cosine transform (MDCT) and wavelet packet transform (WPT) windows by comparing the perceptual energy analyzed in the psychoacoustic model with a predetermined threshold; and a TS processing unit which performs MDCT and WPT for the samples whose bands are divided in the filter bank unit, according to the MDCT and WPT windows selected in the TS selecting unit.

9. The audio compression apparatus of claim 8, wherein the TS processing unit comprises a plurality of wavelet filters that divide samples on a plurality of frequency domains into hierarchical frequency areas.

* * * * *